US005291680A

United States Patent [19]

Schabdach et al.

[11] Patent Number: 5,291,680

[45] Date of Patent: Mar. 8, 1994

[54] GRENADE LAUNCHING APPARATUS

[75] Inventors: Paul G. Schabdach, Churchville; Irving F. Barditch, Baltimore; William G. Rouse, Aberdeen; John P. Fiala, Forest Hill, all of Md.

[73] Assignee: The United States of America as represented by the Secretary of the Army, Washington, D.C.

[21] Appl. No.: 943,657

[22] Filed: Sep. 19, 1992

[51] Int. Cl.[5] ..... F41F 1/00

[52] U.S. Cl. ..... 42/105; 102/217; 102/220; 42/1.01

[58] Field of Search ..... 102/206, 217, 218, 220; 42/105, 1.01; 89/1.55, 1.56, 1.807, 1.814

[56] References Cited

U.S. PATENT DOCUMENTS

| | | | |
|---|---|---|---|
| 3,312,869 | 4/1967 | Werner | 102/217 |
| 3,598,015 | 8/1971 | Delistovich et al. | 89/1.814 |
| 4,068,556 | 1/1978 | Foley | 89/1.814 |

FOREIGN PATENT DOCUMENTS

| | | | |
|---|---|---|---|
| 3013462 | 10/1981 | Fed. Rep. of Germany | 102/206 |

OTHER PUBLICATIONS

Merriam-Webster's New Ninth Collegiate Dictionary, 1985, p. 536.

*Primary Examiner*—Stephen M. Johnson

*Attorney, Agent, or Firm*—Anthony T. Lane; Edward Goldberg; Michael C. Sachs

[57] ABSTRACT

A grenade launching apparatus launches a number of grenades and has a controller and a launcher. The controller controls the launching and includes a selector which is responsive to operator input for selecting one or more of the grenades to be launched. The controller also includes a display for indicating that a selected grenade has been launched. The launcher is for launching one or more of the grenades and includes a firing circuit which is responsive to the selector. The firing circuit activates the launcher to launch each selected grenade. The launcher also includes a launch detector for detecting that a selected grenade has been launched by the firing circuit. The display of the controller is responsive to the launch detector.

3 Claims, 5 Drawing Sheets

103
106
LAUNCHER
112
TO CONTROL
FIRST TONE ($f_2$) DECODER & RESET ($f_1$) DECODER
FIRE
RESET
FIRING CIRCUIT 121
CLOCK & COUNTER
SECOND TONE ($f_3$) GENERATOR
ANSWER BACK
LAUNCH DETECTOR 127
$f_1$
$f_2$
$f_3$
301
303
306
309
312
330
331
332
335
336
340
341
342
345
346
347
351
352
355
356
357
360
361
362
365
366
367
371
372
373
375
376
377
380
381
382
385
133
337

GRENADE LAUNCHING APPARATUS

GOVERNMENT INTEREST

This invention may be made, used or licensed by or for the U.S. Government for government purposes without the payment to us of any royalties thereon.

BACKGROUND OF THE INVENTION

This invention generally relates to grenade launching systems and, in particular, such a system for launching a variety of grenades from a number of launch tubes and for indicating the status of the launch tubes.

Present grenade launching systems in this field are often mounted on an armored vehicle, such as a tank, and the grenades are generally housed in launching tubes outside of the vehicle while the operator remains inside. Thus, controlling the launching of a number of grenades requires penetrations through the hull of the tank, generally through the turret. Wiring for communication from a control portion to a launching portion of the system passes through the holes. Any hole, however, weakens the armor plating which makes the vehicle more susceptible to attack and destruction from armor piercing weapons. Therefore, it is desirable to limit the number and size of hull penetrations.

Presently available grenade launchers are not adaptable for use with a variety of types of grenades. A number of different grenade types may be necessary during combat, such as: smoke emitting, visibility screens, millimeter wave screens, infrared screens, and the like. The different types of grenades are designed to thwart different detection schemes for locating tanks. Therefore, it is desirable to be able to launch specific types of grenades discriminately, i.e., singularly or in combination. Present systems, however, do not provide for individual launch tube control.

Similarly, present grenade launchers do not provide an inventory, or status report, for which grenades have been launched and which grenades are available for launching.

SUMMARY OF THE INVENTION

Among the several objects of the invention may be noted the provision of a grenade launching apparatus permitting fewer and smaller penetrations through the hull; the provison of such apparatus which permits a single hull penetration; the provison of such apparatus which permits individual and combinational control of the launch tubes; the provision of such apparatus which permits a grenade inventory providing a status report of which grenades have been launched and which are available for launching; the provision of such apparatus which permits computer selection and control of the grenade launching; and the provision of such apparatus which permits manual operator interface.

Briefly described, a grenade launcher of the present invention is for launching a number of grenades and has a controller and a launcher. The controller controls the launching and includes a selector which is responsive to operator input for selecting one or more of the grenades to be launched. The controller also includes a display for indicating that a selected grenade has been launched. The launcher is for launching one or more of the grenades and includes a firing circuit which is responsive to the selector. The firing circuit activates the launcher to launch each selected grenade. The launcher also includes a launch detector for detecting that a selected grenade has been launched by the firing circiut. The display of the controller is responsive to the launch detector.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
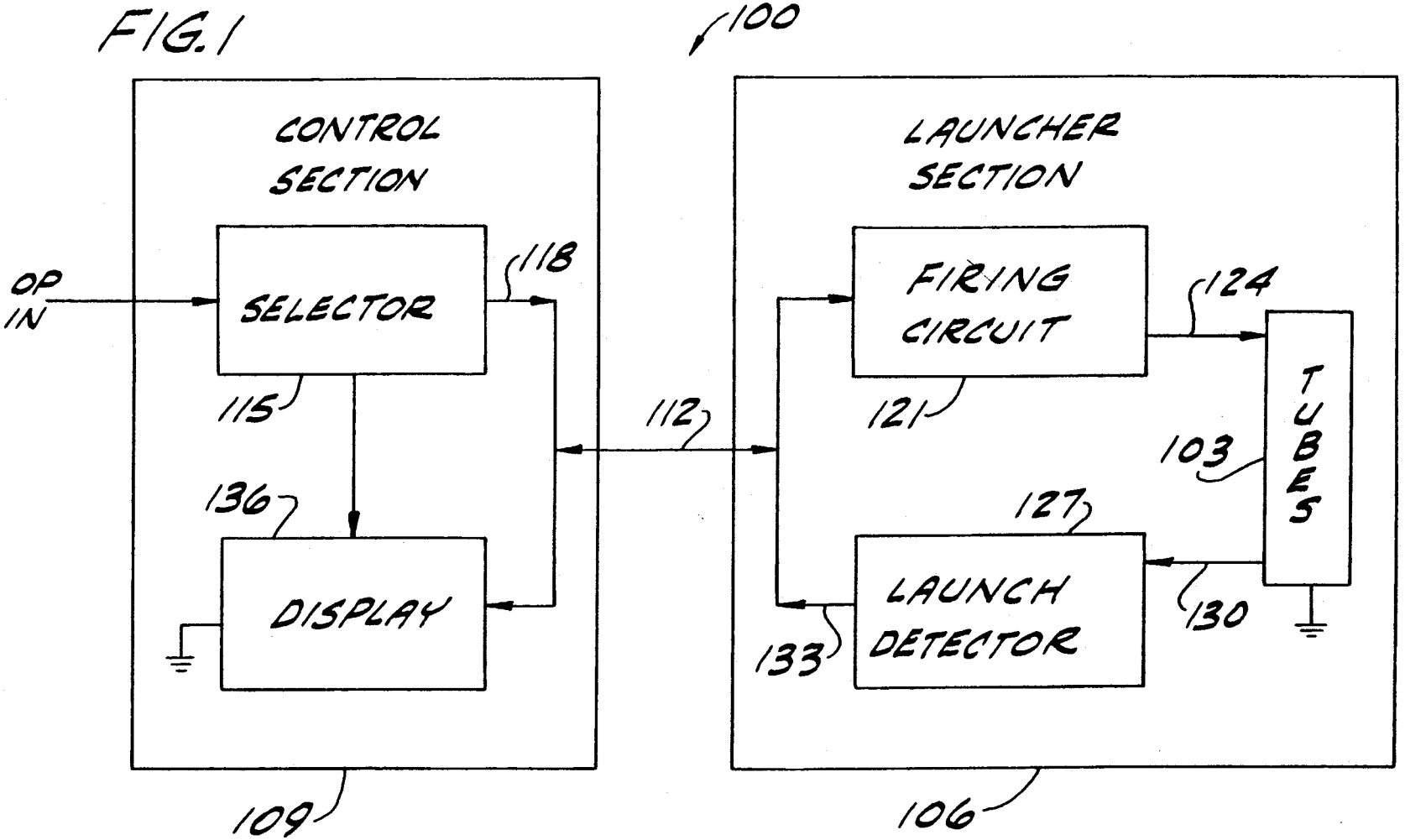
FIG. 1 is a block diagram of a grenade launching system according to the invention including a control section and a launch section.

FIG. 1 is a block diagram of one embodiment of an apparatus 100 for use with a grenade launching system having a plurality of launching tubes 103. The apparatus 100 provides individual or combinational control of the launch tubes 103.

A preferred embodiment provides many types of grenades (not shown) for launching, including: smoke emitting, visibility screens, millimeter wave screens, infrared screens and the like. The grenade launcher 100 is adapted for use with an armored vehicle (not shown), such as a tank and has two portions or sections. A launch section 106 is mounted on the exterior of the tank for launching the grenades and a control section 109 is protected inside the tank's turret. The two sections are connected by a single communication line 112.

As shown in block form in FIG. 1, the control section 109 has a selector 115 for selecting which of the grenades is to be launched responsive to operator input. Operator input may be from a person such as the tank driver or by computer. Launching of the grenades is accomplished by the launch section 106. An output signal from selector 115 via line 118 is communicated to the launch section 106 via line 112. A firing circuit 121, responsive to an output signal from selector 115 via line 124, initiates ignition of the grenades in the plurality of launch tubes 103 housing the various grenades. Grenade launcher 100 further includes a launch detector 127 which monitors the status of the launch tubes 103 via line 130. The launch detector 127 detects which of the grenades have been launched and which are available for future launching. An output signal from the launch detector 127 via line 133 is communicated to the control section 109 via line 112. The control section 109 further includes a display 136 responsive to the launch detector 127 for indicating the inventory or status of the grenades.

Figure 2:
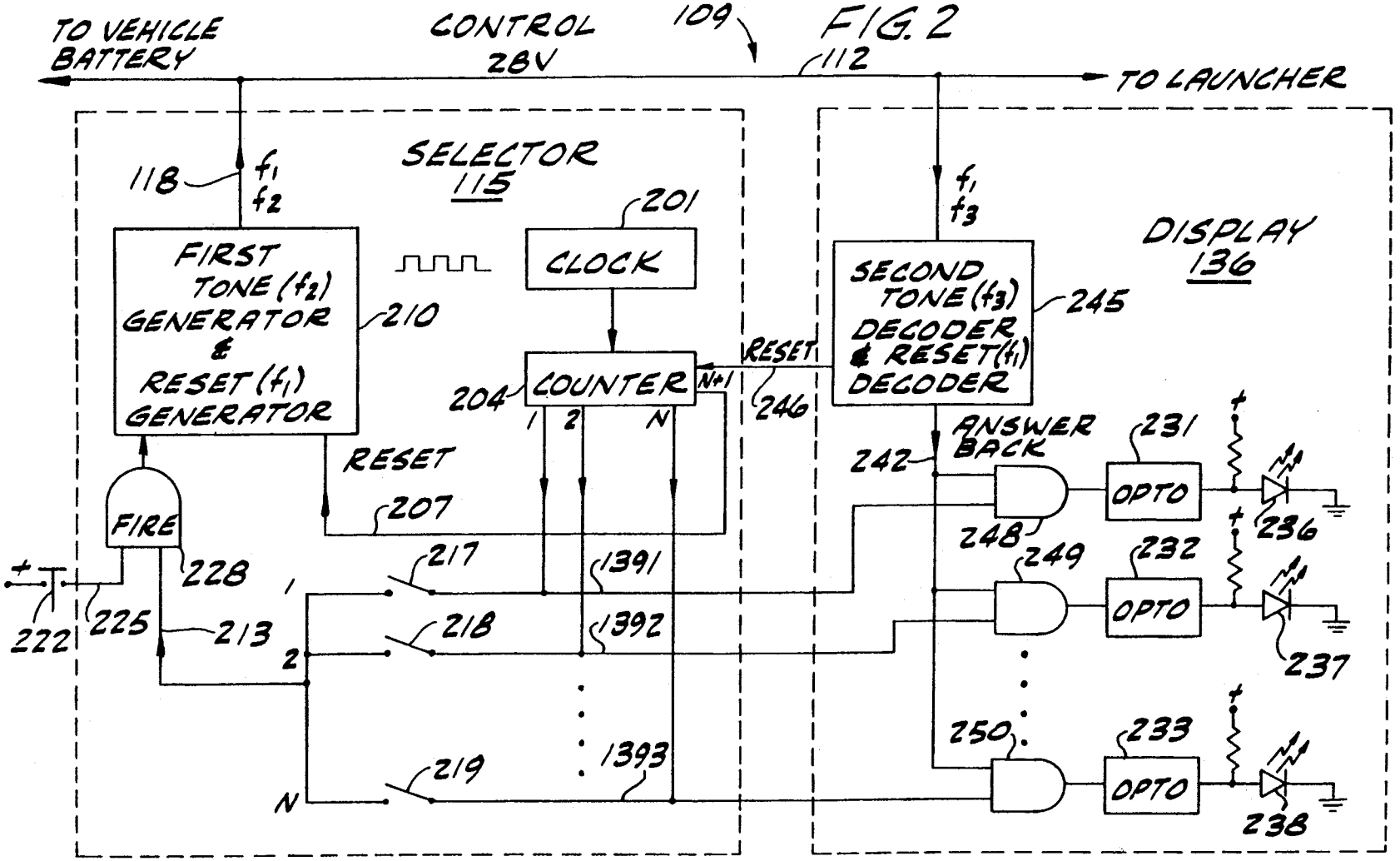
FIG. 2 is a schematic diagram of the control section of FIG. 1 according to the invention.

Referring to FIG. 2, the selector 115 of the grenade launcher 100 sequentially designates which of the grenades have been selected. A control clock 201 produces clock pulses where one or more of the clock pulses corresponds to each of the grenades. Further, the invention provides a control counter 204 for counting the clock pulses.

Figure 3:
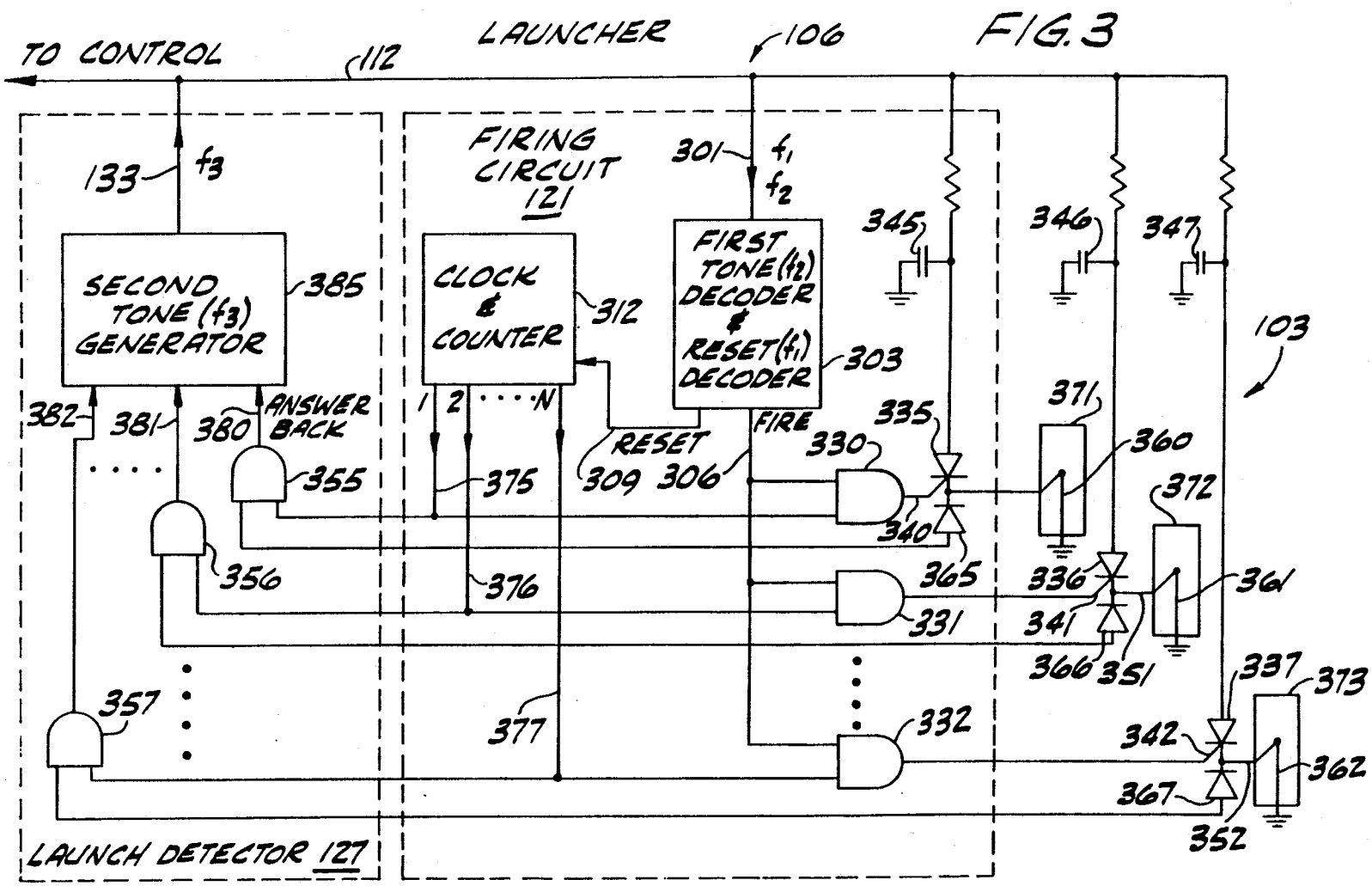
FIG. 3 is a schematic diagram of the launcher section of FIG. 1 according to the invention.

The control counter 204 can be reset by generating a reset signal via line 207 to count again the preselected number of clock pulses corresponding to the number of grenades. When the control section counter 204 reaches a preselected number (e.g., one more than the number of grenades), a first tone generator and reset generator 210 sends out a reset frequency f1 via line 118. The f1 signal is representative of the reset signal and is transmitted along the communication line 112 to the launch section 106 (FIG. 3). The apparatus 100 provides bidirectional communication via line 112 allowing firing and status information to flow between the launch section 106 and the control section 109. Tone generators and tone receiver/decoders, as found in the telecommunication practices, are used for frequency signalling on the single communication line 112.

Referring again to FIG. 2, the control clock 201 and counter 204 are also used to generate a fire signal via line 213 which has one or more clock pulses corresponding to each of the selected grenades. The first tone generator and reset generator 210 generates a frequency f2 representative of the fire signal output from line 118 for transmission along the communication line 112.

The selector 115 produces the fire signal representing which of the grenades have been selected to be launched. To accomplish this, the selector 115 includes a plurality of switches, shown as references 217–219. Each selector switch corresponds to one of the grenades.

Launch tube selector "arm" switches 217–219 are closed to select which of the launch tubes 103 to be fired. A pulse from clock 201 is sent through a closed one of the selector switches 217–219 every time the counter 204 reaches the number corresponding to the particular one of switches 217–219.

Fail-safe operation can be provided by a fire button 222 to be depressed by the operator to initiate the ignition of the grenades in the launch tubes 103. The fire button 222 output via line 225 and the outputs of the selector switches 217–219 are sent to an AND gate 228. When both pulses are present, the tone generator 210 emits a fire frequency f2. Fire frequency f2 is received at the launcher side 106 via communication line 112.

Inventory of the remaining grenades is provided by the display 136. The display 136 includes a plurality of optocouplers shown as reference characters 231–233, each connected respectively to light emitting diodes 236–238. Each optocoupler 231–233 corresponds to one of the grenades. The control counter 204 is used to sequentially designate the optocouplers 231–233 to be activated in response to the answer back signal via line 242. The answer back signal is received and decoded by a second tone decoder and reset decoder 245. The second decoder 245 also receives and decodes frequency f1 for resetting the control counter 204 via line 246. Each activated optocoupler 231–233 removes forward bias from its corresponding light emitting diode 236–238 causing it to extinguish. An extinguished one of LED's 236–238 indicates which of the grenades has been launched.

As the control side counter 204 counts through to the number corresponding to the selected grenade, counter 204 sends a pulse to corresponding AND gate 248–250. With both inputs high, AND gates 248–250 operate, activating optocouplers 231–233, respectively. The optocoupler triac drivers 231–233 lock in short circuited position until reset. Therefore, optocouplers 231–233 provide ground connections on the positive sides of lighted LED's 236–238, extinguishing them. An extinguished light indicates that no grenade is located in the corresponding one of the launch tubes 103.

The present invention provides the inventory feature, referred to as "answer back," which reports on the status of each of the launch tubes 103, i.e., whether the tube houses a grenade or not. Empty launch tubes will cause indicators, such as light emitting diodes 236–238, on the display 136 to extinguish. This is accomplished by communication over the control wire 112.

As shown by FIG. 3, the firing circuit 121 receives the frequency f2 via line 112 and line 301 which is decoded by a first tone decoder and reset decoder 303. The output signal of the decoder 303 via line 306 is the fire signal representing the grenades selected to be launched. The first decoder 303 also receives and decodes frequency signal f1 representative of the reset signal. Further, the decoder provides the decoded reset signal via line 309 to a launch clock and counter 312.

That is, the frequency f1 is input to a first tone decoder 303 and the second tone decoder 245. As such, the frequency signal f1 operates to reset the control counter 204 as well as the launch counter 312 each time the count reaches one more than the number of grenades. The launch counter 312 will be described below.

The outputs of the tone decoder 303 via line 306 and the launch section counter 312 (which operates synchronously with the control section counter 204) are sent to AND gates 330–332, respectively. When both pulses are present, each AND gate 330–332 operates and sends a pulse out which operates silicon-controlled rectifiers 335–337, respectively. Each SCR 335–337 is switched on by a small current at its gate terminal via lines 340–342, respectively, and remains on until the current flowing through it falls below a minimum level. Twenty-eight volts are stored in each of capacitors 345–347 as supplied by the vehicle battery (not shown) via line 112. As SCR's 335–337 conduct, current flows therefrom respectively to fire a plurality of squibs 360–362, respectively. The squibs 360–362 are electrical matches which ignite to launch the grenades. When they ignite, the ground through each squib 360–362 is broken such that one input to AND gates 355–357 goes high. Gates 355–357 are connected to line 112 through diodes 365–367. FIG. 3 shows a plurality of launch tubes 371–373. As the launcher side counter 312 counts through and comes to the number corresponding to a vacated one of launch tubes 371–373, counter 312 sends a pulse to corresponding AND gate 355–357 via lines 375–377.

After grenades have been launched, the launch detector 127 provides an answer back signal via lines 380–382 to the control section 109. The answer back signal is responsive to vacated launch tubes 103. A second tone generator 385 generates a frequency f3 representing the answer back signal for output via line 133 and transmission along the communication line 112; the answer back signal is decoded by the second decoder 245 of FIG. 2. The second decoder 245 also receives and decodes frequency f1 for resetting the control counter 204.

AND gates 355–357 operate to cause the launcher side tone generator 385 to send out the answer back frequency f3 when both inputs are high. Control side tone decoder 245 receives the answer back frequency f3 and transmits the answer back via line 242 to one input of AND gates 248–250.

Referring again to FIG. 3, the plurality of launch tubes 103 house the various grenades to be launched. Each tube 371-373 houses a single grenade. The launch detector 127 detects which of the launch tubes 371-373 have been vacated. Each tube includes a squib 360-362 for electric match, for igniting the selected grenades. The squibs 360-362 ignite in response to the fire signal via line 306.

Figure 4:
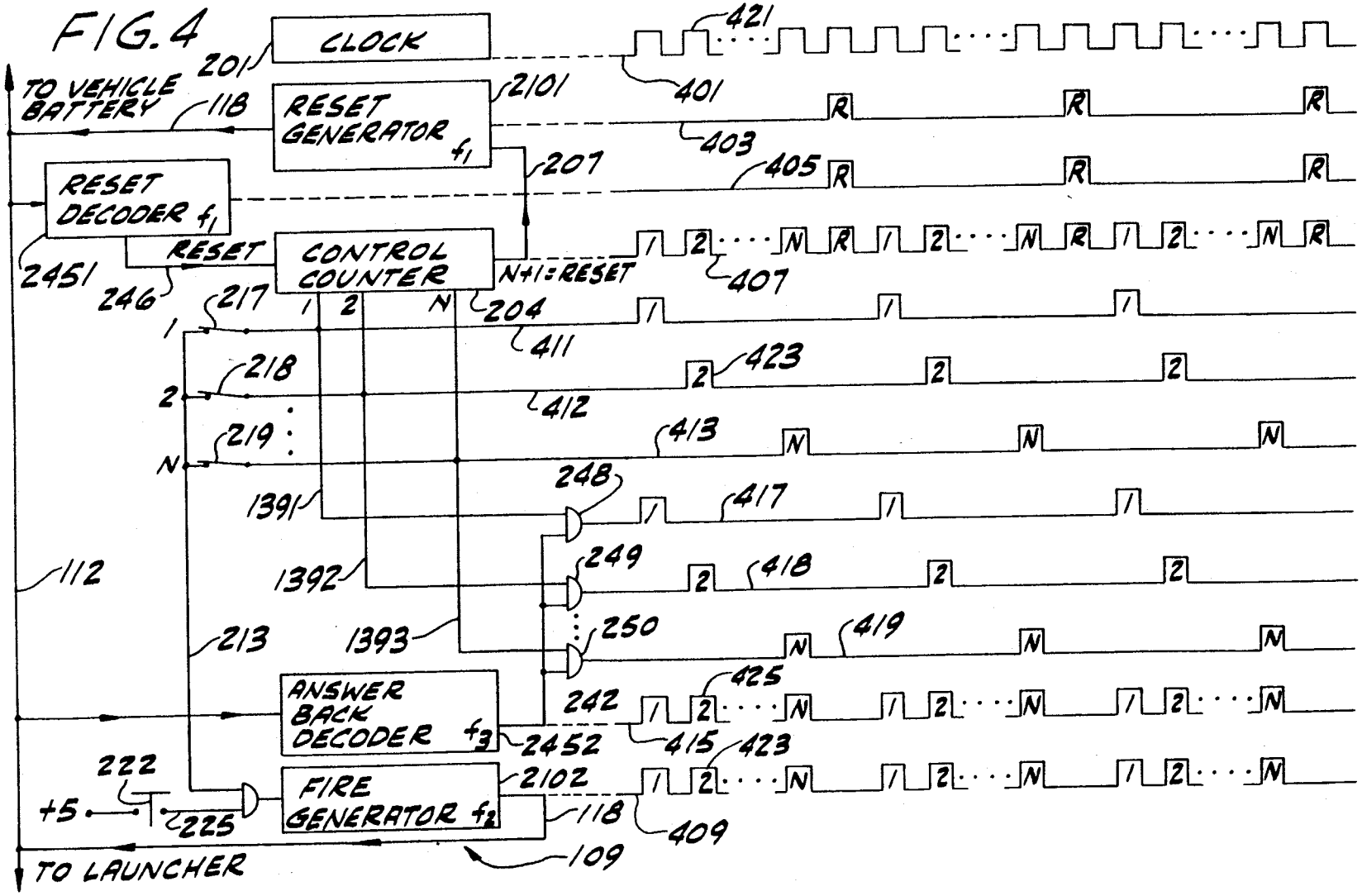
FIG. 4 is a partial schematic and timing diagram of the control section of FIG. 2 according to the invention.

FIG. 4 shows a partial schematic diagram and timing diagram for the control section 109 of the invention. The clock pulses produced by clock 201 are shown by reference character 401. The first tone generator and reset generator 210 may be embodied separately as a reset generator 2101 and a fire signal generator 2102. Similarly, the second tone decoder and reset decoder 245 may be embodied separately as a reset decoder 2451 and an answer back signal decoder 2452.

The control counter 204 transmits a signal via line 207 to cause reset generator 2101 to generate a reset signal via line 118. Each of the clock pulses 401 is counted by control counter 204 until N pulses have been counted, where N may correspond to the number of launch tubes 103. At a count of N+1, reset generator 2101 sends out a reset signal 403. Likewise, reset decoder 2451 receives the reset signal at each count of N+1 as shown by reference character 405. Reference character 407 indicates the counting operation of control counter 204.

Referring again to FIG. 4, fire generator 2102 generates the frequency f2 representative of the fire signal output. Reference character 409 shows the output signal from fire generator 2102 when selector switches 217-219 are closed to indicate selection of a first, second and Nth grenade for launching.

Switches 217-219 are selectively closed by the operator to select which grenades are to be fired. A pulse from clock 201 is sent through a closed one of the selector switches 217-219 every time the counter 204 reaches the number corresponding to the particular one of switches 217-219. Timing waveforms 411-413 show pulses conducted through switches 217-219, respectively.

Reference character 415 snows the waveform as received by answer back decoder 2452. The waveform 415 is representative of which of the grenade launch tubes 103 have been vacated. Further, the answer back signal is generated by second tone generator 385.

According to the present invention, the control counter 204 sequentially designates the selected grenades (see waveforms 411-413). The invention also provides for the answer back signal as received and decoded by the decoder 2452.

As the control counter 204 counts through to the number corresponding to the selected grenade, counter 204 sends a pulse to corresponding AND gate 248-250. With both inputs high, AND gates 248-250 operate to supply a pulse. Thus, the output signals from gates 248-250 are shown by reference characters 417-419, respectively.

Figure 5:
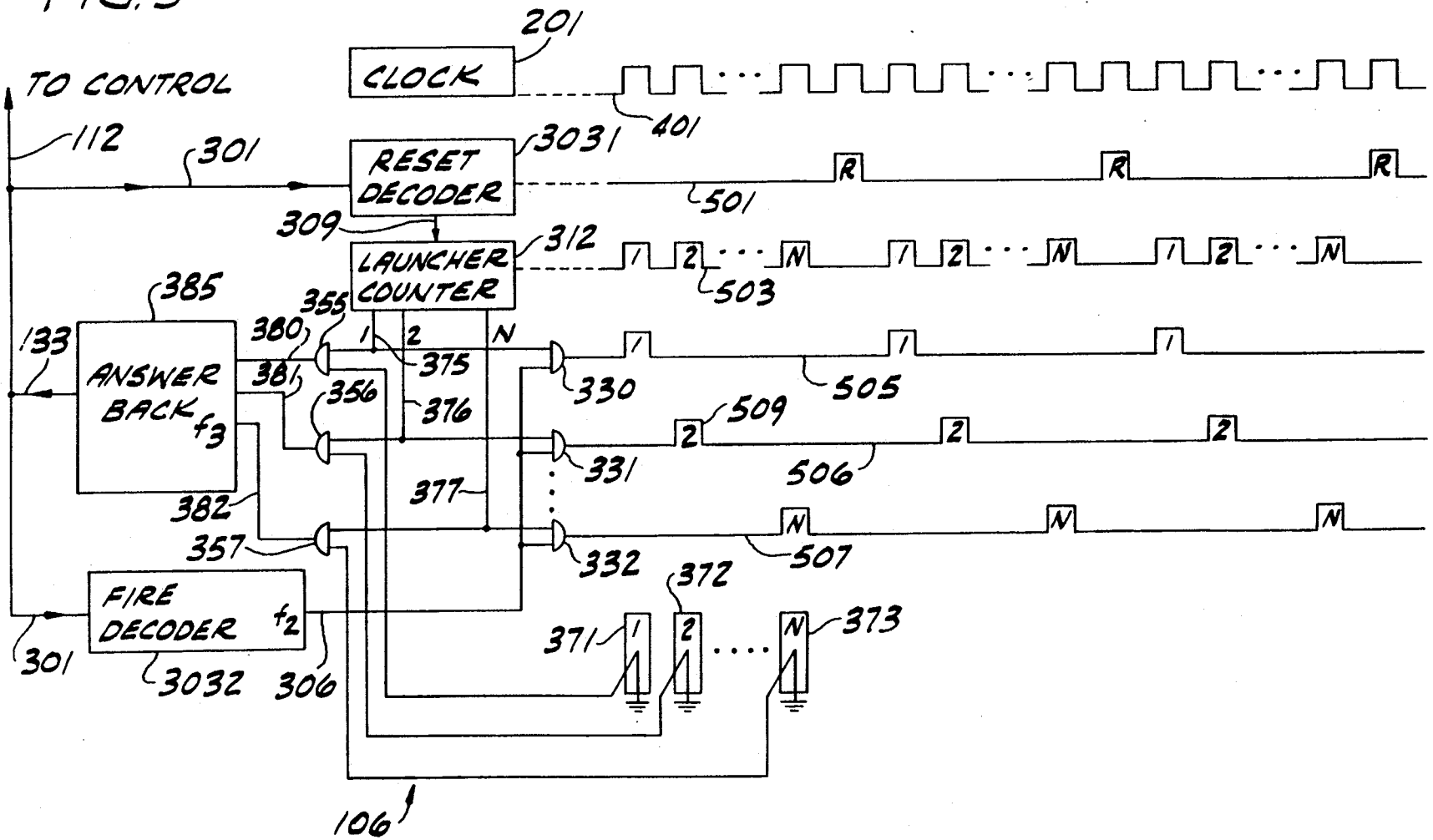
FIG. 5 is a partial schematic and timing diagram of the launcher section of FIG. 3 according to the invention.

FIG. 5 shows a partial schematic diagram and timing diagram for the launcher section 106 of the invention. The first tone decoder and reset decoder 303 may be embodied separately as a reset decoder 3031 and a fire signal decoder 3032.

As shown by FIG. 5, the reset decoder 3031 receives the frequency f1 reset signal. The output signal of the decoder 3031 are reset pulses 501. Further, the decoder 3031 provides the decoded reset signal via line 309 to the launch clock and counter 312. The timing waveform for the launch counter 312 is shown by reference character 503.

The outputs of the tone decoder 3032 via line 306 and the launch section counter 312 are sent to AND gates 330-332, respectively. When both pulses are present, each AND gate 330-332 operates to send a pulse out according to waveforms 505-507, respectively.

Referring again to FIGS. 2-5, as an example, if the operator desires for the grenade housed in launch tube 372 to be launched, the operator may close selector switch 218. On the second clock pulse (see reference character 421) generated by clock 201, one input to gate 228 via line 213 is logic level high (see reference character 423). In order for launching to occur, the operator may depress firing switch 222 so that the output of AND gate 228 is logic level high. A high output signal from gate 228 causes the first tone generator 210 (or fire signal generator 2102) to generate a signal at a frequency f2 which is transmitted to launcher 106 via communication line 112 (see reference character 423). The first tone decoder 303 (or fire signal decoder 3032) receives the fire frequency f2 and produces a logic level high output signal in accordance therewith. The high output signal is a pulse which is synchronized with the second pulse of clock 201. As such, one input of gate 331 goes high synchronously with the other input which goes high via line 376 (see reference character 509). This is possible because counter 312 and counter 204 are synchronized by the reset signal via lines 309 and 246, respectively.

Launching of the grenade housed in tube 372 occurs as the high signal via line 341 causes SCR 336 to conduct to ignite squib 361. As squib 361 is burned out, diode 366 is reversed biased to breakdown because a ground is no longer provided through the squib 361. Thus, one input to gate 356 goes high. The other input likewise goes high via line 376 which produces a high output signal via line 381. The high signal via line 381 causes the second tone generator 385 to generate a signal at a frequency f3 which is transmitted to controller 109 via communication link 112. The second tone decoder 245 (or answer back decoder 2452) receives the answer back frequency f3 and produces a logic level high output signal in accordance therewith (see reference character 425). The high output signal is a pulse synchronized with the second pulse of clock 312.

Display 136 indicates for the operator that the grenade housed in tube 372 has been launched. The high output pulse from second tone decoder 245 (or answer back decoder 2452) provides a high input to gate 249 via line 242. The other input goes high via line 1392 on the second clock pulse from clock 201 to produce a logic level high at reference character 427. Optocoupler 232 conducts when the output of gate 249 is high which removes the forward bias from LED 237. Thus, LED 237 extinguishes, displaying that the grenade housed in tube 372 has been launched.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A grenade launcher for launching a plurality of grenades which includes a controller, comprising:

a selector responsive to operator input for selecting one or more of the grenades to be launched, said selector including means for sequentially designating which of the grenades have been selected wherein said means for sequentially designating includes means for producing a clock signal having one or more clock pulses corresponding to each of the selected grenades and means for assigning the clock pulses to the grenades for designating which of the grenades have been selected; and display means for indicating that a selected grenade has been launched;

and means for launching one or more of the grenades comprising:

a firing circuit responsive to the selector for activating said launching means for launching each said selected grenade; and a launch detector for detecting that a selected grenade has been launched by the firing circuit, wherein said display means is responsive to said launch detector.

2. A grenade launcher for launching a plurality of grenades which includes a controller, comprising:

a selector responsive to operator input for selecting one or more of the grenades to be launched, said selector including means for sequentially designating which of the grenades have been selected;

display means for indicating that a selected grenade has been launched; and means for launching one or more of the grenades comprising:

a firing circuit responsive to the selector for activating said launching means for launching each said selected grenade said firing circuit including means for sequentially activating said launching means to launch each of the selected grenades in a preset order responsive to said means for sequentially designating which of the grenades have been selected; wherein said means for sequentially activating said launching means includes means for producing a clock signal having one or more clock pulses corresponding to each of the selected grenades, wherein said means for sequentially activating said launching means is synchronized with said means for sequentially designating which of the grenades have been selected; and a launch detector for detecting that a selected grenade has been launched by the firing circuit, wherein said display means is responsive to said launch detector.

3. A grenade launcher for launching a plurality of grenades comprising: a controller comprising:

a selector responsive to operator input for selecting one or more of the grenades to be launched, said selector including means for sequentially designating which of the grenades have been selected, display means for indicating that a selected grenade has been launched; and means for launching one or more of the grenades comprising:

a firing circuit responsive to the selector for activating said launching means for launching each said selected grenade, said firing circuit including means for sequentially activating said launching means to launch each of the selected grenades in a preset order responsive to said means for sequentially designating which of the grenades have been selected;

a launch detector for detecting that a selected grenade has been launched by the firing circuit, wherein said display means is responsive to said launch detector; and means for providing a reset signal for synchronizing said launching means to said controller for a preselected number of clock pulses corresponding to each of the grenades that are selected.

* * * * *